United States Patent [19]

Leonard

[11] 4,351,233

[45] Sep. 28, 1982

[54] PRESS

[76] Inventor: Frank W. Leonard, 4501 Federal Way, Boise, Id. 83705

[21] Appl. No.: 318,467

[22] Filed: Nov. 5, 1981

Related U.S. Application Data

[63] Continuation of Ser. No. 113,738, Jan. 21, 1980, abandoned.

[51] Int. Cl.[3] ..... B30B 15/16

[52] U.S. Cl. ..... 100/48; 100/53; 100/209; 100/229 R; 100/256; 100/258 A; 100/269 A; 100/295

[58] Field of Search ..... 100/43, 48, 53, 258 R, 100/258 A, 229 R, 256, 52, 209, 269 A, 295

[56] References Cited

U.S. PATENT DOCUMENTS

| | | | |
|---|---|---|---|
| 1,698,613 | 1/1929 | Van Duzer | 100/229 R |
| 2,243,205 | 5/1941 | Hall | 100/258 A |
| 3,135,998 | 6/1964 | Fowler | 100/269 A |
| 3,791,289 | 2/1974 | Lamorte | 100/256 |

FOREIGN PATENT DOCUMENTS

| | | | |
|---|---|---|---|
| 2289409 | 5/1976 | France | 100/269 A |

*Primary Examiner*—Billy J. Wilhite
*Attorney, Agent, or Firm*—Eugene M. Eckelman

[57] ABSTRACT

An expandable bag is supported on a base and is associated with first and second platen means. The first platen is movable in a pressing operation relative to the second platen by expansion and contraction of the bag. The second platen is movable relative to the first platen in a plane parallel with the pressing surfaces of the platen for loading articles onto and unloading them from the first platen. The second platen has backup support for pressing functions by the frame of the press. The second platen is carried on a wheeled support for its movement in a plane parallel with the pressing surfaces and is associated with shock absorbers at the limits of its travel. Controls are provided for sequence functioning of the expandable bag and the second platen. The press has an opening at the top adjacent the front which is opened and closed by movement of the second platen.

9 Claims, 6 Drawing Figures

PRESS

This application is a continuation of application Ser. No. 113,738, filed Jan. 21, 1980, now abandoned.

FIELD OF THE INVENTION

This invention relates to new and useful improvements in press constructions and is particularly concerned with a press structure of the type which is opened and closed for each pressing operation.

SUMMARY OF THE INVENTION

An important objective of the invention is to provide a press structure which uses a pair of platens one of which moves in a plane parallel with the pressing surfaces in the opening and closing movements of the press and the other of which is driven in pressing operations toward the movable platen by an inflatable air bag.

Another object is to provide a press of the type described which employs housing portions with longitudinal backup means arranged to bear the pressing forces applied from a powered platen, thus allowing various structural components of the press to be of minimal structure and yet allowing the pressing formation of structural members of substantial length.

Yet another object is to provide a press of the type described which employs an upright frame with a top opening above a loading platen for easy loading and unloading and with a movable platen which in its advanced pressing position spans the opening and closes the press. It is a further object to provide such a structure which may employ both front and rear openings with a loading platen associated with each opening and a single movable platen which in a horizontal movement has pressing association alternately with the loading platens, thus providing a press with double loading capabilities.

Still other objects of the invention are to provide novel stabilizing means for holding the loading platen parallel with the other platen as said loading platen moves under the driving power of the inflatable air bag, to provide shock absorber means for the movable platen to minimize shock and to reduce noise in operation; and to provide novel control means for advancing and retracting the movable platen as well as to coordinate such movement with the pressing operation, such control means also employing safety features to open the press in the event of an emergency. Another object is to provide means in a press of the type described which adjustably controls the travel of the press as well as the pressure that the press will apply.

For the purpose of carrying out these objectives, the press has support means such as a housing with a top loading opening. The housing has a reaction member under the loading opening which supports an expandable air bag associated with pressure applying and release means. A first platen is supported on the air bag for pressing movement controlled by expansion and contraction of the bag. A second platen is associated with the first platen for pressing operations and is movable relative too the first platen between open and closed positions of the press in a plane parallel with the pressing surfaces. The housing and second platen have interengaged relation in the closed position of the press whereby the housing bears the pressing forces of the lower platen in forming a backup support for the second platen. The housing includes guiding and stabilizing means for the first platen to provide uniform dimensional pressing. Power means are associated with the air bag and drive means for the second platen, and such power means have a novel control in functions of closing the press, operative movement of the first platen, and opening of the press. Such power means also includes controls for varying the travel of the first platen, for limiting maximum pressure that the press can apply, and for safety operation.

The invention will be better understood and additional objects and advantages will become apparent from the following description taken in connection with the accompanying drawings.

DETAILED DESCRIPTION OF PREFERRED EMBODIMENTS

Figure 1:
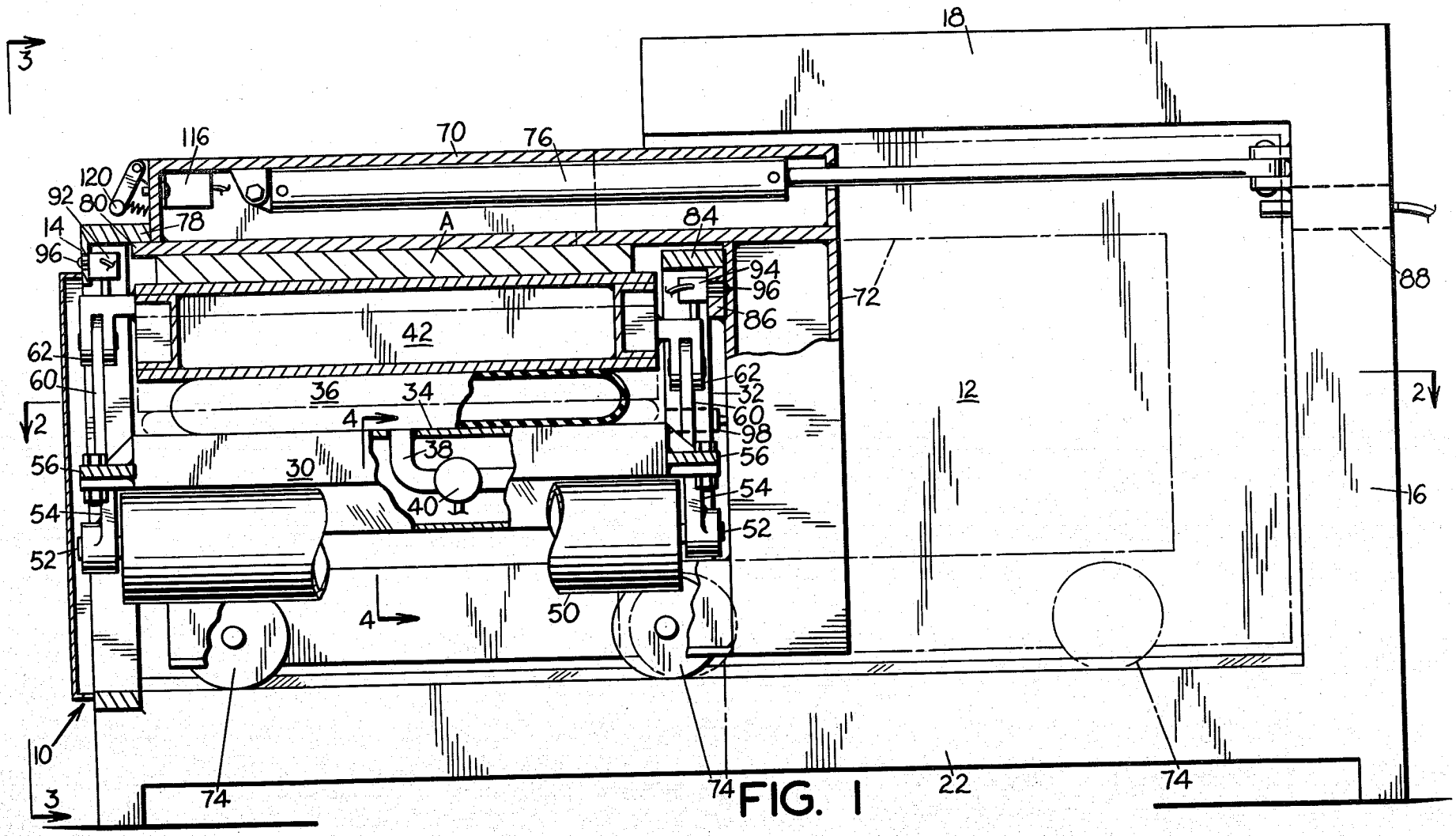
FIG. 1 is an end elevational view of a press structure embodying the instant invention, this view being taken on the line 1—1 of FIG. 2 and being partly in section and also having portions thereof broken away.

With particular reference to the drawings and first to FIGS. 1-4, the press of the invention comprises a housing 10 employing enclosing side panels 12, a front wall 14, a rear wall 16, and a partial top wall 18 extending forwardly from the rear wall, the top area of the housing in front of the partial wall 18 forming a loading area for the press. Housing 10 has front to rear, bottom frame members 22 adjacent the ends and similar frame members, not shown intermediate the ends as required.

Integral with the frame is a lower reaction member 30 which extends horizontally and rearwardly from the front wall 14 under the loading area of the press. This member has a rear upstanding extension 32. The top of reaction member 30 comprises a flat surface 34, and an inflatable air bag 36 is seated on such surface. Air bag 36 has suitable connection to a conduit 38, FIGS. 1 and 5, connected to a source of pressure and having a main inlet valve 40 therein.

Seated on the air bag 36 is a first or lower platen 42 which has a longitudinal length extending from side to side of the press. Upon inflation of the air bag 36, platen 42 is forced upwardly to accomplish a pressing operation on an article A, as will be more apparent hereinafter.

Platen 42 is guided in its upward movement and held against any appreciable horizontal shifting by two or more vertical guide rods 44 secured on the housing and slidably engaged by apertured ears 46 rigidly attached to the platen. This platen is also held against tilting from front to rear or vice versa by a torque tube 50 at each end rotatably supported on shafts 52 in turn supported on depending ears 54 on brackets 56 integral with the reaction member 30. Torque tubes 50 have an integral projecting lever arm 58 at each end pivotally connected to respective upstanding links 60 pivotally connected at their upper ends to depending ears 62 integral with the platen 42. Since the torque tubes are held rotatably in a horizontal plane by the fixed reaction member 30, the front and rear connections thereof with the platen 42 will similarly hold such platen in a horizontal plane regardless of unbalanced pressures to which the platen may be subjected. Thus, the platen 42 will always move straight up even though it may be operating on an article being pressed that is of non-uniform thickness.

Lower platen 42 is associated with a second or upper platen 70 integral with a carriage 72 having wheel-track support 74 on front to rear frame members 22. Carriage 72 is arranged to move the platen 70 across the press opening for placement in a pressing position as shown in full lines in FIG. 1 or to retract this platen for loading and unloading the press as shown in broken lines in FIG. 1. The drive for the carriage comprises double acting air cylinders 76 connected between the carriage and the housing.

The upper platen 70 has backup reinforcement from the frame in its closed position so that the pressing forces exerted from the lower platen are taken up by the press frame rather than by the upper platen itself. For this purpose, the front wall 14 extends up into the plane of the platen 70 and has a rearwardly extending projection 78 arranged to have overlapping relation with a projection 80 on the front edge of the platen 70. Also, the rear upstanding extension 32 of the reaction member 30 has a rearward projection 84 arranged for overlapping relation with a projection 86 on the front of carriage 72.

When the press is closed, the projections 78, 80 and 84, 86 are in their respective overlapping relation, and when the platen 42 is driven upwardly by the air bag, the projections engage each other whereby the upward thrust from the pressing forces is taken up by the frame. For this purpose, the frame is well reinforced, particularly along the front wall 14 and upstanding portion 32. In a preferred arrangement, the projections 78, 80 and 84, 86 extend substantially the full width of the press opening so that the upper platen has full longitudinal backup by the frame.

Since the upper platen has backup support against the thrust of the press throughout substantially its width it can be relatively light in structure, the primary span which requires strength thus comprising only the front to rear dimension. In addition, since the air bag will by its nature produce a uniform pressure on the bottom of the lower platen 42, this platen likewise can be of relatively light structure. Another advantage of the present arrangement is that upon a thrust being applied against the upper platen 70 and the said platen rising slightly as the projections engage, the wheeled support 74 of the carriage lifts slightly and the carriage does not bear any of the thrust of the press.

Figures 2, 3, 4:
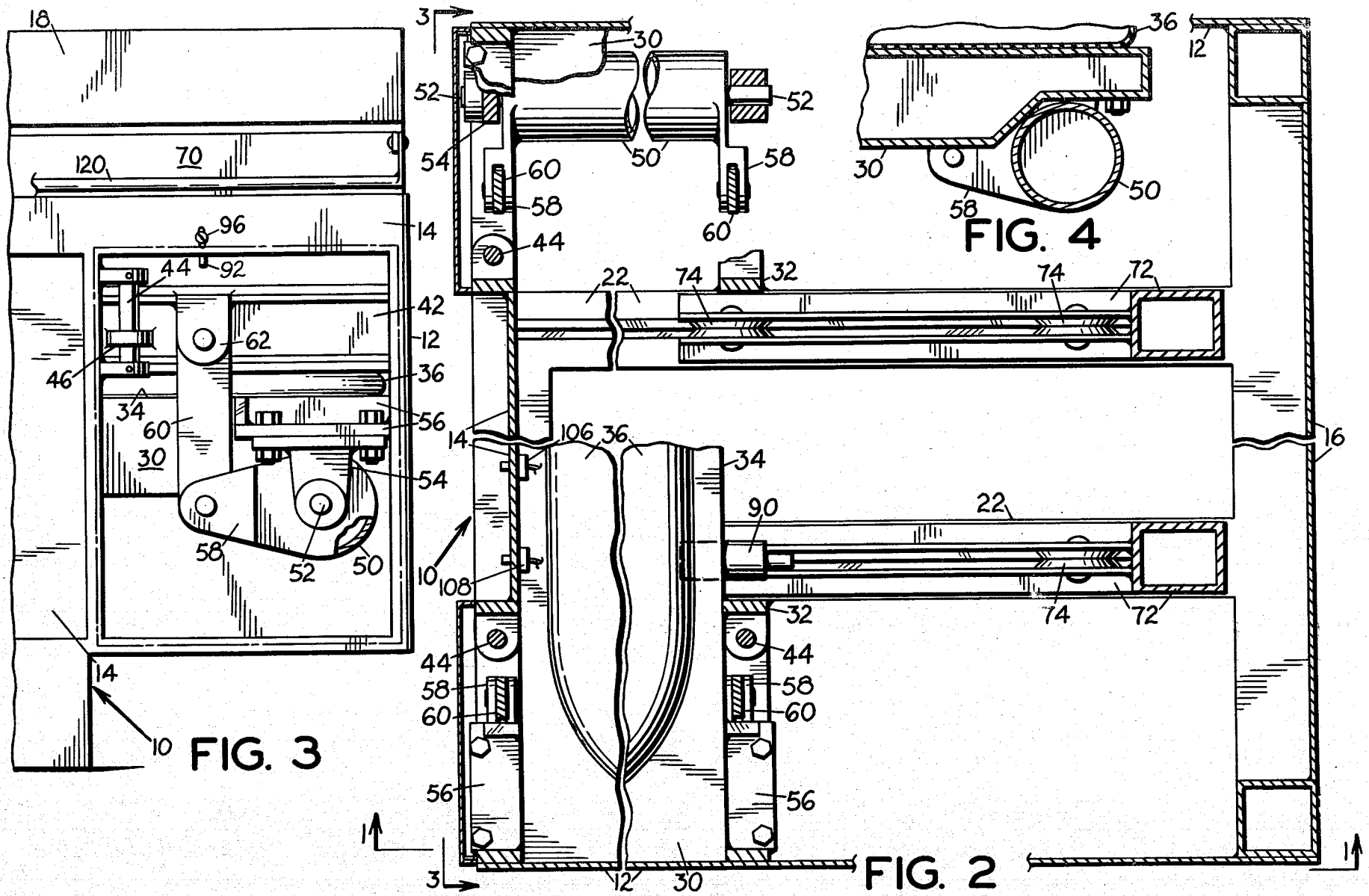
FIG. 2 is a horizontal, sectional view taken on the line 2—2 of FIG. 1, this view being foreshortened in both longitudinal and lateral directions.
FIG. 3 is a fragmentary front elevational view taken on the line 3—3 of FIG. 1.
FIG. 4 is a fragmentary sectional view taken on the line 4—4 of FIG. 1.

A shock absorbing air cylinder 88, FIG. 1, is secured to the rear wall 16 of the press in the path of the carriage and a similar cylinder 90, FIG. 2, is secured to the rear of the reaction member 30 also in the path of the carriage 72. These shock absorbers cushion carriage movement at both limits of travel to reduce shock to the parts and to lessen the noise from carriage movement.

With particular reference to FIG. 1, a normally closed stroke switch 92 is mounted on the frame, adjacent the front of the platen 42 and a normally closed stroke switch 94 is mounted on the carriage adjacent the rear of the platen 42. These switches are in the path of movement of the platen, such as over the ears 62, and as will be seen hereinafter, they are arranged to control the upward movement of the platen in its pressing operation. These switches are each mounted for vertical adjustment by mounting screws 96 to adjust the plane of the pressing surface of platen 42 in the end pressing movement of the latter.

The control means of the system also includes a pilot valve 98 mounted on the rear extension 32 and as will be more apparent hereinafter this pilot valve controls valve 40 such that compressed air at the valve 40 is shut off from the air bag 36 at all times except when the carriage 72 is forward in engagement with valve 98 and projections 80 and 86 are locked under the projections 78 and 84, respectively.

Figure 5:
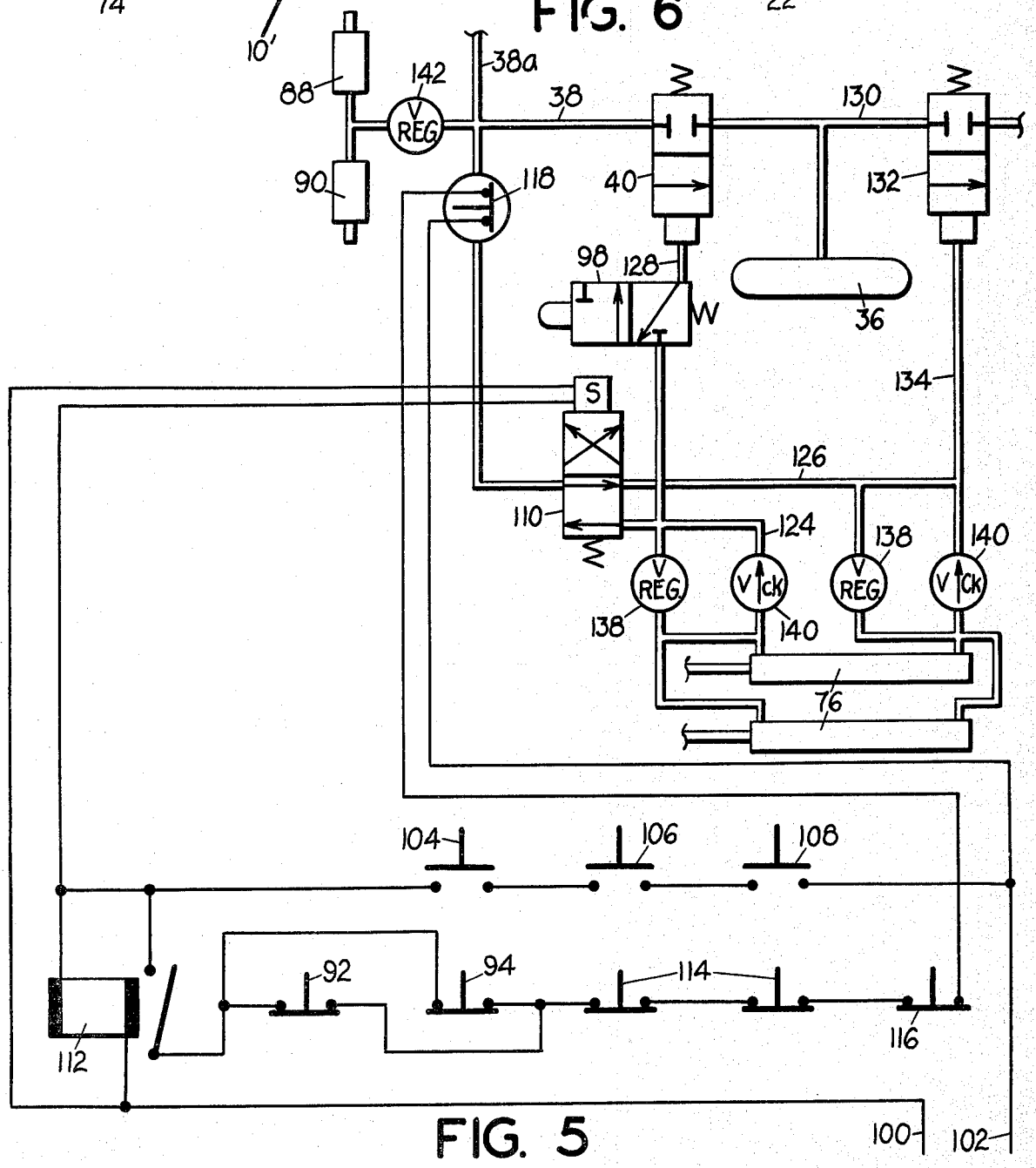
FIG. 5 is a schematic diagram of electric and pneumatic control and power means for the press.

With particular reference to FIG. 5, the conduit 38 from air bag 36 is connected to a source **38*a* of air pressure. Valve 40 is of a conventional type which is opened by an air signal from another source. The electric and pneumatic system of the invention comprises an electric circuit having infeed lines 100 and 102. The circuit includes an on/off main control switch 104 and a pair of start switches 106 and 108 biased to a normally open position by internal spring means, the three switches 104, 106 and 108 leading from line 102 and being in series. The system includes a multidirectional control valve 110 operated by a solenoid connected across feed lines 100 and 102 through switches 104, 106 and 108. The electric circuit further includes a relay 112 also connected across infeed lines 100 and 102 through switches 104, 106 and 108. The relay has a holding circuit through its normally open contact arm 112*a*, this holding circuit when activated extending from infeed line 100 through the coil of the relay 112, to line segment 102 having switches 104, 106 and 108 therein, through contact arm 112*a* and then to the infeed portion of line 102 in bypassing relation to the segment with switches 104, 106, and 108 and through the stroke switches 92 and 94, as well as through one or more normally closed door interlock switches 114, a normally closed safety switch 116, and a normally closed pressure switch 118. The switches 92, 94, 114, 116, and 118 are connected in series with each other but in parallel with switches 104, 106 and 108**.

Safety switch 116 is mounted on the front of platen 70, FIG. 1, and is arranged to be opened by pivotal movement of an elongated spring held bar 120 on the platen 70 located so as readily to be depressible by the operator if it is desired that the carriage be stopped and returned. Start switches 106 and 108 are mounted on the front of the housing for easy access to the operator but requiring both hands to close the circuit. The pressure switch 118 is mounted in the compressed air source **38*a* and is arranged to open the electrical circuit to the solenoid operated valve 110 upon the pressure source reaching a selected pressure. Such pressure switch is adjustable in a well known manner so as to open the circuit at preselected pressures. The two strokes switches 92 and 94** are connected in parallel with each other so that both of these switches must be engaged by the platen in order to open the electrical circuit.

Pressure source **38*a* leads to solenoid operated multidirectional valve 110 and through such valve has controlled connection to the carriage drive cylinders 76 by conduits 124 and 126. Conduit 124 also leads to pilot valve 98 which as stated hereinbefore has a structure arranged to allow compressed air to pass to main inlet valve 40 only upon engagement thereof by the carriage. Signal means 128** are connected between the pilot valve 98 and the main inlet valve 40 in an arrangement such that when the pilot valve is engaged by the carriage, the main inlet valve allows pressured air to travel to the air bag 36. Air bag 36 has an exhaust conduit 130 associated with a dump valve and muffler assembly 132. Signal means 134 are connected between the valve 132 and conduit 126 and operate to open the valve 132 to exhaust upon the return movement of carriage 72 by air cylinders 76.

The pressure system also includes speed regulators 138 in the conduits 124 and 126 to control the speed of the carriage, and suitable check valves 140 are mounted in the conduits. Also, the shock absorber cylinders 88 can be fed by the air pressure system 38*a*, and a regulator valve 142 is in the conduit to such cylinders to provide the desired shock absorbing resistance.

OPERATION

In starting a pressing operation with the platen 70 being retracted, the operator presses the start switches 106 and 108, it being assumed that the main switch 104 is already closed and all the other switches 92, 94, 114, 116, and 118 are also closed. Temporarily closing the circuit by means of both spring return opening switches 106 and 108 energizes the solenoid of the valve 110 and also energizes the relay 112 through the line segment incorporating switches 104, 106 and 108. When the relay 112 is energized, its contact arm 112*a* closes and the holding circuit for the relay which extends from line 100 through the coil of the relay, through the contact arm 112*a* and back to the line 102 through the switches 92, 94, 114, 116 and 118, is established to maintain the system in operating condition. With the operation of the valve 110, pressured air is admitted to the carriage drive cylinders 76 through conduit 124 so as to move the carriage toward a closing position of the press. The carriage moves to its full forward position wherein projection 78, 80 and 84, 86 are in overlapping relation at which time the pilot valve 98 is operated to produce a signal to main inlet valve 40 and open the inlet to air bag 36 to the pressure system 38*a*.

The carriage is held fully forward by the driving force in cylinders 76, and the air bag will continue to expand in the pressing operation until platen 42 is driven up against both stroke switches 92 and 94. When both of the switches 92 and 94 are opened, the holding circuit to relay 112 is broken to cause deenergization of solenoid operated valve 110. Valve 110 thus returns to its rest position which reverses the air passage to carriage cylinders 76 and the carriage is driven rearwardly to open the press. As the air cylinders start their return movement, the exhaust air therefrom signals the dump valve 132 to open and exhaust the air bag 36. The press can then be unloaded and loaded for the next similar operation.

Expansion of the air bag 36 may be controlled as well by air switch 118 in that if it desired to rely on a pressure limit between the platens rather than a distance limit, the switch 118 can be set to accomplish such function. Also, the switch 118 can be set to serve as a safety means so that articles cannot be overly pressed or the system damaged.

As apparent in FIG. 5, the carriage will be stopped and returned by the opening of any one of the switches 114, 116 and 118 or opening of the two stroke switches 92 and 94. Thus, if any switch in the door interlocks or the machine is opened, the carriage will stop and return. Such is also the case in the event that the safety bar 120 is depressed by the operator. This bar extends the full width of the carriage and is easily accessible to the operator in the event that a problem should exist or in the event that it is desired that the carriage be stopped and returned.

Figure 6:
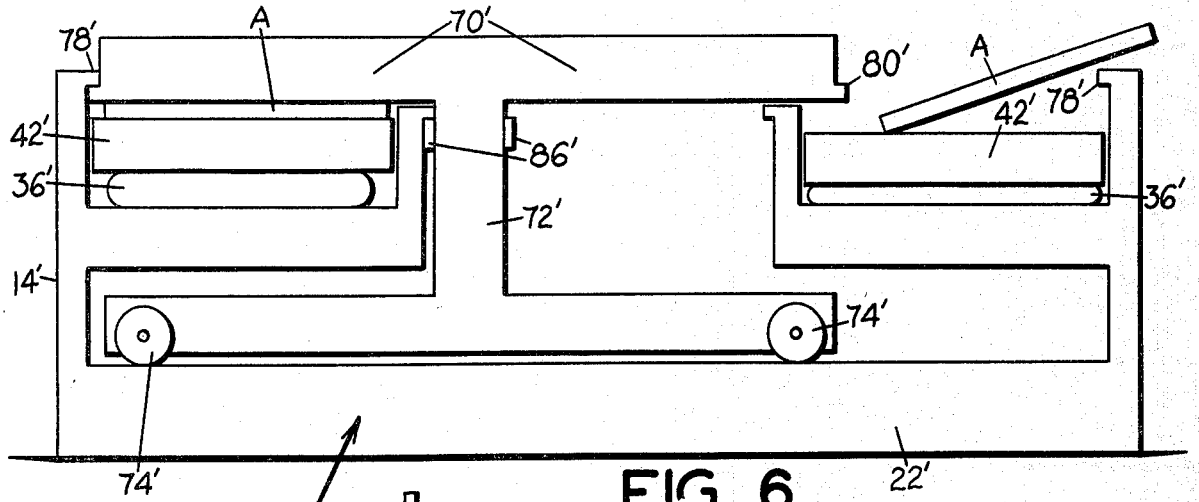
FIG. 6 is a diagrammatic end view of a modified press structure embodying features of the instant invention.

With reference to FIG. 6 which is somewhat diagrammatic, the concept of the invention can be applied to a double loading press employing a frame 10′ having similar front wall portions 14′ and other wall portions as in the FIG. 1 embodiment. This press employs a press opening at each of the front and rear thereof and each is associated with its own upper platen 42′ and air bag 36′. A common upper platen 70′ is provided on a carriage 72′ operating on suitable track-wheel support 74′ on the press. Carriage 72′ is driven forwardly and rearwardly by one or more double acting cylinders as in FIG. 1.

By means of the structure of FIG. 6, the carriage can be loaded on one side, such as is shown on the right side, while it is pressing on the other side, such as is shown on the left side, and such alternate operation can be continued to effect fast pressing operations.

The present press has important advantages one of which is that it provides an easy loading and unloading area which is very convenient to operators. Also, the press is useful in compressing articles that are loosely assembled since there is no lateral movement into a pressing area which can displace the assembled parts. The use of the combination electric and pneumatic control and power means makes use of conventional apparatus since a usual air compressor and the usual 110 volt circuit are all that are necessary. Furthermore, the lateral frame support of the upper platen and the uniform pressure exerted by the air bag allows the platens to be of lightweight structure. In addition, this frame backup for the upper platen allows articles to be constructed which have substantial length such as roof trusses.

It is to be understood that the invention may take other forms and all such modifications and variations which will occur to persons skilled in the art are included in the invention. For example, the embodiment of FIG. 1 is shown and described as a top opening press with vertical movement of the lower platen. However, it is apparent that the concept of the platen movement and the operation of the other platen could be in planes other than for upright pressing movement.

Having thus described my invention, I claim:

1. A press construction for forming elongated articles comprising (a) an upright frame having laterally elongated, vetically reinforced front and rear portions as well as side, top and bottom portions, (b) first platen means having a laterally elongated pressing surface for supporting elongated articles in the press and having vertical powered movement in pressing operations, (c) second platen means having front and rear portions and a laterally elongated pressing surface facing the pressing surface of said first platen means, (d) and projection means on each of the front and rear portions of said second platen means and also on each of the reinforced front and rear frame portions, (e) said projection means extending substantially the full lateral length of said second platen means and said frame, (f) said second platen means being movable relative to said first platen means in a plane parallel with said pressing surface to move between an advanced pressing position in overlapping relation with said first platen means for pressing articles and a retracted position for loading and unloading articles on said first platen, (g) both of said front and rear projection means on said second platen means in the retracted position of the latter being out of engagement with the projection means on said frame but being disposed in underneath engagement with said front and rear projection means of said frame respectively in the advanced pressing position of said second platen means whereby upward pressing forces of said lower platen means in pressing operations against the second platen means is transferred to said vertically reinforced frame portions.

2. The press construction of claim 1 wherein said second platen means is mounted on a carriage having movable support on said frame independently of said rear projection means.

3. The press construction of claim 1 wherein said frame includes a top wall extending partially from rear to front of said press, said top wall covering said second platen means in the retracted position of the latter.

4. The press construction of claim 1 including an operator's station at the front of said frame, and an opening in said frame at the top thereof above said first platen means for loading articles onto said first platen means and removing them, said opening being in substantially the same plane as the path of movement of said second platen means, said second platen means in its advanced pressing position spanning said opening enclosing the same whereby to provide unobstructed loading and unloading of articles onto said first platen means from said operator's station.

5. The press construction of claim 1 wherein said frame includes a top wall extending partially from rear to front of said press, said top wall covering said second platen means in the retracted position of the latter, an operator's station at the front of said frame, and an opening in said frame at the top thereof above said first platen means and in front of said top wall for loading articles onto said first platen means and removing them, said opening being in substantially the same plane as the path of movement of said second platen means, said second platen means in its advanced pressing position spanning said opening enclosing the same whereby to provide unobstructed loading and unloading of articles onto said first platen means from said operator's station.

6. A press construction comprising (a) support means, (b) a base surface on said support means, (c) an expandable bag on said base surface, (d) pressure applying and release means connected to said bag and arranged to cause expansion and contraction of said bag, (e) first platen means associated with said bag, (f) said first platen means having a pressing surface movable in a pressing operation by expansion and contraction of said bag, (g) second platen means having a longitudinal pressing surface facing the pressing surface of said first platen means to form an abutment for articles being compressed upon expansion of said bag, (h) said second platen means having horizontal wheeled support on said frame for movement in a plane parallel with said pressing surfaces between an advanced pressing position in overlapping relation with said first platen means for pressing articles by expansion of said bag and a retracted position for loading and unloading articles onto said first platen, (i) power drive means for advancing and retracting said second platen means, (j) and shock absorber means operative between said frame and said second platen means for cushioning limit positions of movement of said second platen means.

7. A press construction comprising (a) support means, (b) a base surface on said support means, (c) an expandable bag on said base surface, (d) pressure applying and release means connected to said bag and arranged to cause expansion and contraction of said bag, (e) first platen means associated with said bag, (f) said first platen means having a pressing surface movable in a pressing operation by expansion and contraction of said bag, (g) second platen means having a longitudinal pressing surface facing the pressing surface of said first platen means to form an abutment for articles being compressed upon expansion of said bag, (h) said second platen means having horizontal wheeled support on said frame for movement in a plane parallel with said pressing surfaces between an advanced pressing position in overlapping relation with said first platen means for pressing articles by expansion of said bag and a retracted position for loading and unloading articles onto said first platen, (i) power drive means for advancing and retracting said second platen means, (j) and control means operative on said pressure applying and release means and on said power drive means for causing said bag to be pressurized at the time that said second platen means reaches its pressing position and for reversing the movement of said second platen means and exhausting said bag upon completion of a pressing step by said first platen means.

8. A press construction comprising:

(a) support means including an upright frame having front, rear and side portions as well as top and bottom portions, (b) a base surface on said support means, (c) an expandable bag on said base surface, (d) pressure applying and release means connected to said bag and arranged to cause expansion and contraction of said bag, (e) first platen means associated with said bag, (f) said first platen means having a pressing surface for supporting articles in the press and being movable upwardly in a pressing operation by expansion and contraction of said bag, (g) second platen means having a longitudinal pressing surface facing the pressing surface of said first platen means to form an abutment for articles being compressed upon expansion of said bag, (h) said second platen means being movable relative to said first platen means in a plane parallel with said pressing surface to move between an advanced pressing position in overlapping relation with said first platen means for pressing articles by expansion of said bag and a retracted position for loading and unloading articles onto said first platen, (i) power drive means for advancing and retracting said second platen means, (j) an opening in said frame above said first platen means for loading articles onto said first platen means and removing them, said second platen means in its advanced pressing position spanning said opening and closing the same, (k) and operator actuated control means for said power drive means arranged to stop advancing movement and to retract said second platen means.

9. A press construction comprising (a) support means including an upright frame having front, rear and side portions as well as top and bottom portions, (b) a base surface on said support means adjacent both the front and rear portions of said press, (c) an expandable bag on each of said base surfaces, (d) pressure applying and release means connected to said bags and arranged to cause expansion and contraction of said bags, (e) first platen means associated with each of said bags, (f) said first platen means having pressing surfaces for supporting articles in the press and being movable upwardly in a pressing operation by expansion and contraction of said bags, (g) second platen means having a longitudinal pressing surface facing the pressing surface of said first platen means to form an abutment for articles being compressed upon expansion of said bags, (h) said second platen means being movable relative to said first platen means in a plane parallel with said pressing surfaces to move between an advanced pressing position in overlapping relation with each of said first platen means for pressing articles by expansion of said bag and a retracted position for loading and unloading articles onto said first platen means, (i) and an opening in said frame above each of said first platen means for loading articles onto said first platen means and removing them, (j) said second platen means in its advanced pressing positions spanning said openings and closing the same.

* * * * *